United States Patent [19]

Dupuis et al.

[11] Patent Number: 4,969,573

[45] Date of Patent: Nov. 13, 1990

[54] PACKAGING POT HAVING HINGED SUPERPOSED CLOSURES

[75] Inventors: Yves Dupuis, Tournus; Jacques Durand, Givry, both of France

[73] Assignee: Reboul-SMT, Creteil Cedex, France

[21] Appl. No.: 421,767

[22] Filed: Oct. 16, 1989

[30] Foreign Application Priority Data

Oct. 28, 1988 [FR] France ..... 88 14123

[51] Int. Cl.[5] ..... B65D 51/18

[52] U.S. Cl. ..... 220/259; 220/4 R; 220/255; 220/283; 220/339

[58] Field of Search ..... 220/215, 254–259, 220/337, 339, 281, 283, 469, 4 B, 334, 4 R; 229/2.5 R

[56] References Cited

U.S. PATENT DOCUMENTS

| | | | |
|---|---|---|---|
| 2,195,593 | 4/1940 | Kreisler | 220/259 |
| 2,491,426 | 12/1949 | Tamoschat | 220/337 X |
| 2,656,946 | 10/1953 | Clarke | 220/4 R X |
| 3,214,074 | 10/1965 | Schechter | 229/2.5 R |
| 3,221,919 | 12/1965 | Gessner | 220/337 |
| 3,391,765 | 7/1968 | Baker | 220/334 X |
| 3,405,836 | 10/1968 | Regis, Jr. | 220/339 X |
| 3,536,435 | 10/1970 | Schurman . | |
| 3,552,595 | 1/1971 | Gerner | 220/339 X |
| 4,005,800 | 2/1977 | Schuman | 220/337 |
| 4,040,561 | 8/1977 | Philippon | 220/259 X |
| 4,505,404 | 3/1985 | Perchak et al. | 220/339 |

FOREIGN PATENT DOCUMENTS

| | | |
|---|---|---|
| 0093442 | 11/1983 | European Pat. Off. . |
| 8803737 | 7/1988 | Fed. Rep. of Germany . |
| 572426 | 2/1976 | Switzerland . |

*Primary Examiner*—Bryon P. Gehman

*Attorney, Agent, or Firm*—Allegretti & Witcoff, Ltd.

[57] ABSTRACT

A packaging pot for marketing various products, comprising a container housed within a casing body covered by a casing lid which pivots about a horizontal articulation, with a resilient snap-action closure system releasable by manual action on an externally projecting lug. The container is clamped in a single-piece ring comprising a lower annular member which is integral with the container and a pivoting upper annular member which is joined to the lower annular member by means of a flexible hinge-strap, the two annular members being provided respectively with complementary snap-fastening elements, the top portion of the casing body being fastened around the lower annular member and the bottom portion of the casing lid being fastened around the upper annular member.

9 Claims, 4 Drawing Sheets

FIG. 2
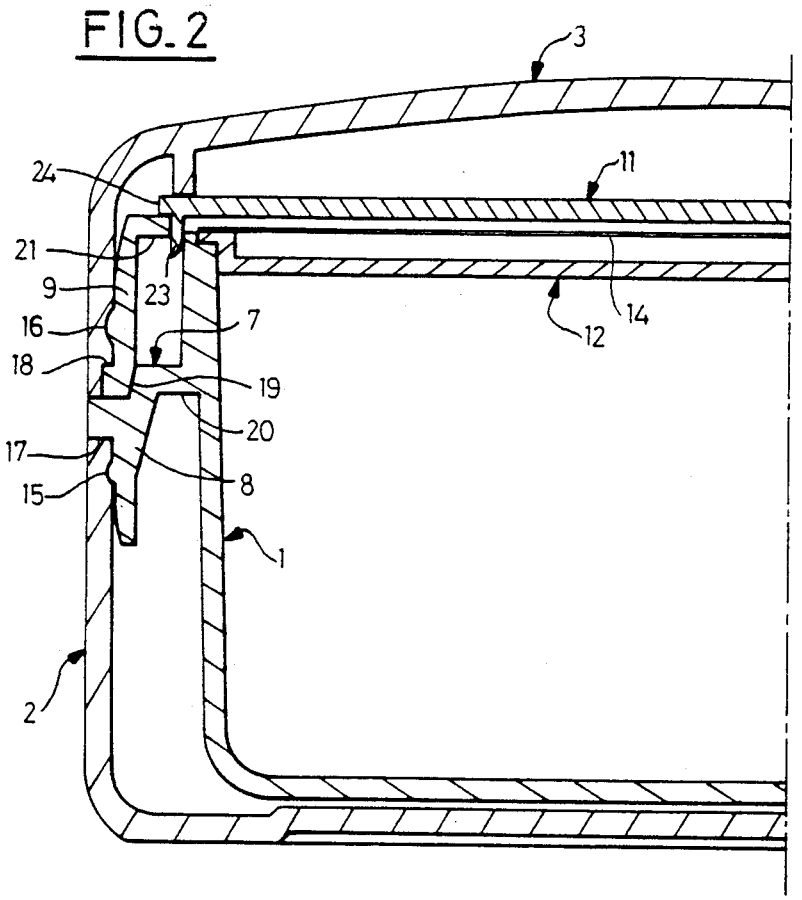
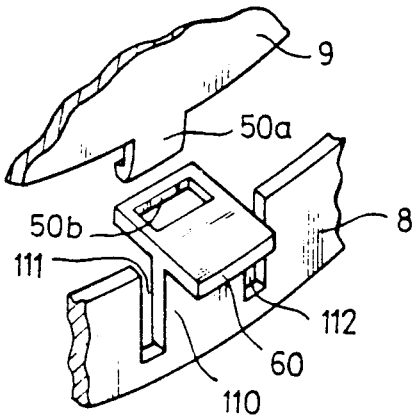
FIG. 6

PACKAGING POT HAVING HINGED SUPERPOSED CLOSURES

BACKGROUND OF THE INVENTION

1. Field of the Invention

The present invention relates to the packaging industry and more particularly to pots of molded plastic with attached lid for marketing various products, especially cosmetics, pharmaceuticals and cleaning products as well as foods and industrial products such as creams, pastes, gels, powders, ointments, more or less fluid emulsions, milks, food products, paints.

2. Description of the Prior Art

In order to market products cf this type, especially for the general public, it is endeavored to obtain an appearance which is as attractive and conspicuous as possible for the lowest price. If the products concerned are manufactured on a large scale, packages which are specific to each product are created. However, when products are manufactured on a relatively limited scale, as is the case with the majority of cosmetics, pharmaceuticals, cleaning or food products, it is a common practice to make use of standardized packages which are differentiated by specific labeling for each product or category of product of the same line. However, this standardization results in uniformity of presentation which is not very attractive.

The invention is directed to an inexpensive packaging pot which can be formed by assembling together an extremely small number of elements, part of which can be standardized and produced on a large scale but part of which is specific and makes it possible to give an original personalized appearance for each product, thus overcoming the above-mentioned disadvantages of conventional pots.

SUMMARY OF THE INVENTION

The object of the invention is to provide a packaging pot for marketing various products, comprising a container housed within a casing body covered by a casing lid which pivots about a horizontal articulation with a resilient snap-action closure system releasable by manual action on an externally projecting lug. The distinctive feature of the pot lies in the fact that the container is clamped within a single-piece ring comprising a lower annular member which is integral with the container and a pivoting upper annular member which is joined to the lower annular member by means of a flexible hinge-strap, the two annular members being provided respectively with complementary snapfastening elements, the top portion of the casing body being fastened around the lower annular member, and the bottom portion of the casing lid being fastened around the upper annular member.

In an advantageous embodiment, the elements for relative snap-fastening of the two annular members comprise a strip which can be resiliently thrust back by hand towards the interior of the pot and which is derived from one of the annular members, said strip being provided with a terminal hook directed outwards in the vicinity of an external extension constituting a snap-fastening release push-button which project outside the pot between the casing body and the casing lid whilst an inwardly directed oppositely-acting hook is derived from the other annular member.

In order to prevent any possibility of accidental opening by young children, a pot of this type can have two symmetrical snap-fastening devices located in diametrically opposite relation on each side of the hinge-strap. It is thus necessary to withdraw both snap-fastening closure devices at the same time in order to release the lid and open the pot.

For lower-cost industrial manufacture, a pot in accordance with the invention comprises a standardized container-ring assembly and interchangeable casing elements, namely body and lid, which are adaptable respectively on the upper and lower annular members of the ring. The expression "standardized container ring assembly" as used in this specification and in the appended claims means the container is fixed or constant with respect to size and shape in contrast to replaceable casing bodies and lids which attach to said container. It does not mean the container ring assembly was previously known.

In a simplified embodiment, a pot in accordance with the invention can be formed of only three elements, the container and the ring being formed by molding in one piece on which are adapted a casing body and a casing lid.

In order to ensure good leak-tightness of the container throughout the period of use of the pot, there can be added to this latter a cover which fits over the neck of the container and is secured to the upper annular member of the ring.

With a view to ensuring perfect leak-tightness up to the time of initial use, there can be added a detachable protective sealing cap which is resiliently engaged in an annular groove cut within the top portion of the neck of the container and provided on its external top face with a projecting holding lug.

In accordance with a practical form of construction, the protective sealing cap has the shape of a dish, the holding lug being entirely contained within the hollow portion and made inaccessible until the pot is used for the first time by means of a tearable guarantee membrane which is sealed on the outer peripheral edge of the protective cap.

In order to provide customers with evidence that the closure system has not been tampered with, a guarantee membrane which can be torn off when the pot is opened for the first time can also be sealed on the edge face of the container neck and if necessary on the periphery of the protective cap.

BRIEF DESCRIPTION OF THE DRAWINGS

FIG. 2 is a schematic half-view in axial cross-section outside the articulation and the closure system of the pot of FIG. 1.

FIG. 6 is a schematic view in perspective showing an alternative form of closure system.

DESCRIPTION OF THE PREFERRED EMBODIMENTS

Figure 1:
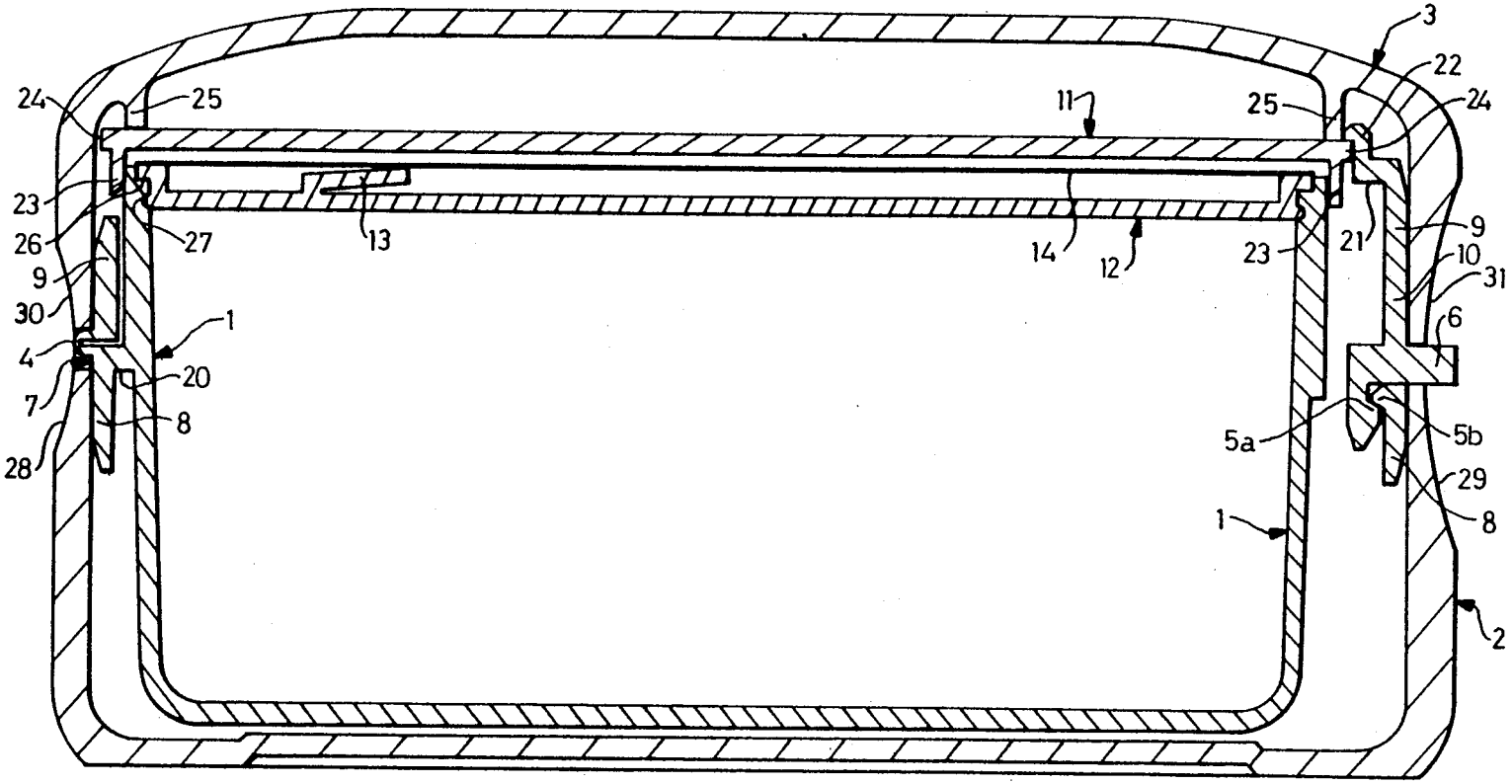
FIG. 1 is a schematic view in vertical axial cross-section through the articulation and the closure system of a packaging pot in accordance with the invention.

In these figures, corresponding elements are designated by the same numerical references. The respective dimensions and proportions of these elements may not be observed in order to ensure enhanced clarity of the drawings.

The packaging pot shown in these figures essentially comprises a container 1 molded in one piece with a surrounding ring 7 comprising two coaxial annular members in the form of vertical skirts, namely a lower annular member 8 derived from the external lateral wall of the container 1 and forming an extension of a horizontal annular flange 20, and an upper annular member 9 which is joined to the lower annular member 8 by a flexible hinge-strap 4. The open top portion of a casing body 2 is snap-fastened around the lower annular member 8 whilst the open bottom portion of a casing lid 3 is snap-fastened around the upper annular member 9.

On the side remote from the hinge-strap 4, the upper annular member 9 has an extension in the form of an inwardly displaced but outwardly directed hook **5*a* which overlaps with respect to the lower annular member 8 when the two annular members 8, 9 are engaged over each other so as to cooperate with an inwardly directed hook 5*b* derived from the lower annular member 8 in order to constitute a snap-action closure system. A lug 6 derived from the upper annular member 9 above the hook 5*a* and projecting outside the ring constitutes a manual push-button which makes it possible to release the latched closure system at will by elastic deformation of the upper annular member 9 in the vicinity of the hook 5*a***.

The casing body 2 and the casing lid 3 are latched respectively in the lower annular member 8 and upper annular member 9 of the ring 7 by means of conventional coordinated rib and groove assemblies 15, 16 respectively (FIG. 2) except in the location opposite to the hinge-strap 4 and the closure system **5*a*, 5*b* in order to allow the freedom of deformation of the annular members 8, 9 which is necessary for good operation. Annular abutment shoulders 17, 18 respectively ensure good axial positioning of the casing body 2 and of the casing lid 3** respectively.

A portion of reduced thickness 28, 29 and 30, 31 respectively of the wall of the body 2 and of the lid 3 in the vicinity of the hinge-strap 4 and of the closure system **5*a*, 5*b* frees these portions in order to ensure better operation of the articulation and easier access to the lug 6 for opening the pot. Thus the tip of the lug 6** does not project beyond the outer shell of the pot and is protected against accidental impacts while making it easier to pack the pot.

Good centering of the upper annular member 9 on the lower annular member 8 and consequently of the lid 3 on the body 2 in the position in which they are closed against each other is ensured by cooperation of two complementary conical portions 19 of the lateral ends of the annular members 8 and 9 which come respectively into contact in the closed position.

The upper annular member 9 has an extension at its outer end in the form of a notched annular internal flange 21, the recessed portions of which are extended by inwardly directed hooks 22. This arrangement makes it possible to place and maintain in position by snap-action engagement the projecting flat top wall 24 of a cover 11 having the shape of a flat dish, the annular side wall 23 of which is adapted to fit externally over the neck of the container 1 in order to ensure leak-tightness during utilization of the pot with the lid in the closed position. The casing lid 3 is provided internally with a coaxial annular flange 25, the free edge of which is applied against the top wall of the cover 11 in the vicinity of the hooks 22 and of the wall 23 of the cover 11, thus ensuring that the cover 11 is very effectively secured to the upper annular member 9 and the casing lid 3 during repeated handling operations which involve opening and closing of the pot.

The internal edge of the container 1 is recessed so as to form an annular shoulder 26 which serves as a support for the peripheral edge of a protective cap 12 in the shape of a flat dish. A rib which projects externally from the bottom wall of said protective cap is snap-actingly engaged in a corresponding groove 27 cut in the marginal side wall of the container 1. A holding lug 13 derived from the internal face of the bottom wall of the protective cap 12 facilitates removal of this latter for initial use. This protective cap 12 ensures complete leak-tightness throughout the period of storage of the pot. The lug 13 does not extend beyond the top edge of the dish of the protective cap 12, thus making it possible to position a guarantee membrane 14 which is heat-sealed or adhesively fixed on the edge face of the peripheral flange of the protective cap 12. In order to gain access to the holding lug 13 and to remove the protective cap 12, the first user has to tear off the membrane 14, thus leaving an undelible trace of breaking-in which guarantees the customer against any prior fraudulent opening of the pot.

Figure 3:
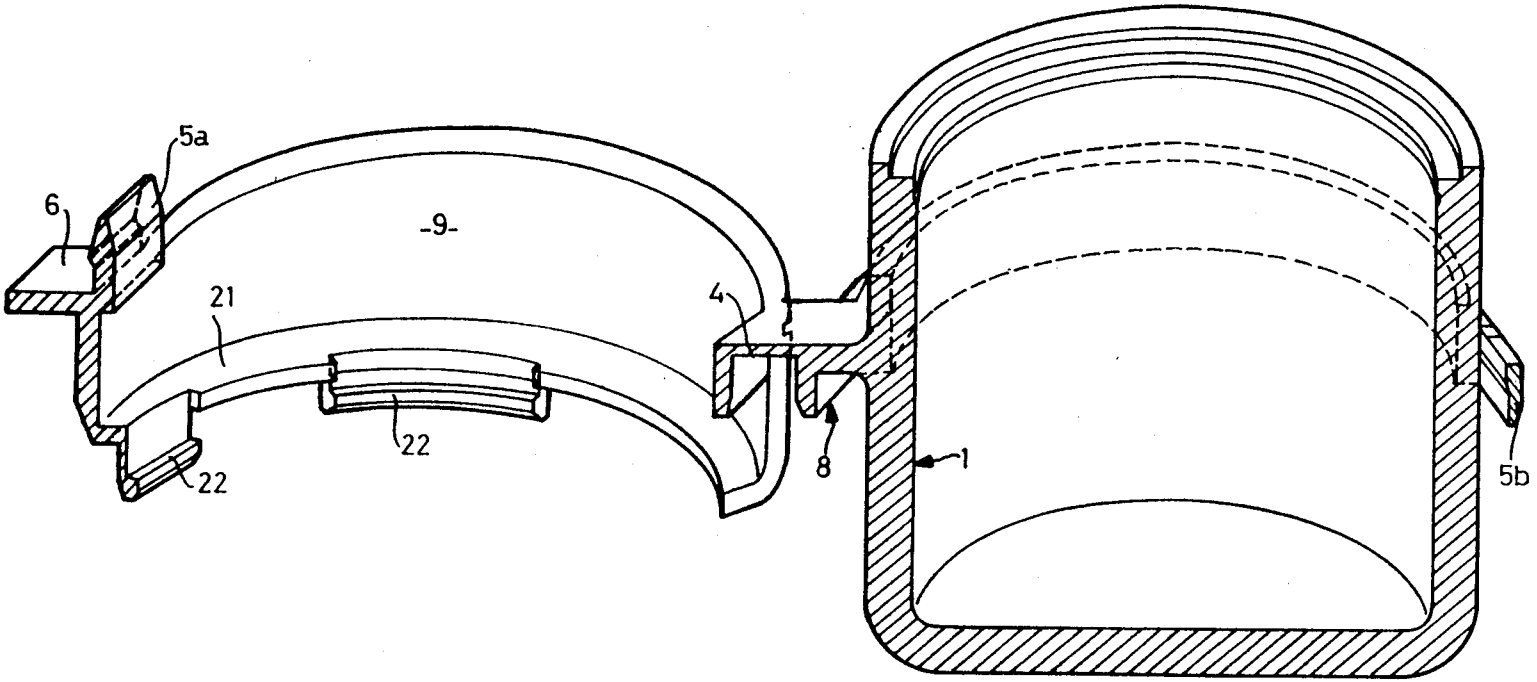
FIG. 3 is a schematic view in axial cross-section on with one-half in perspective, showing the standard ring-container of the pot of FIGS. 1 and 2.
Figure 5:
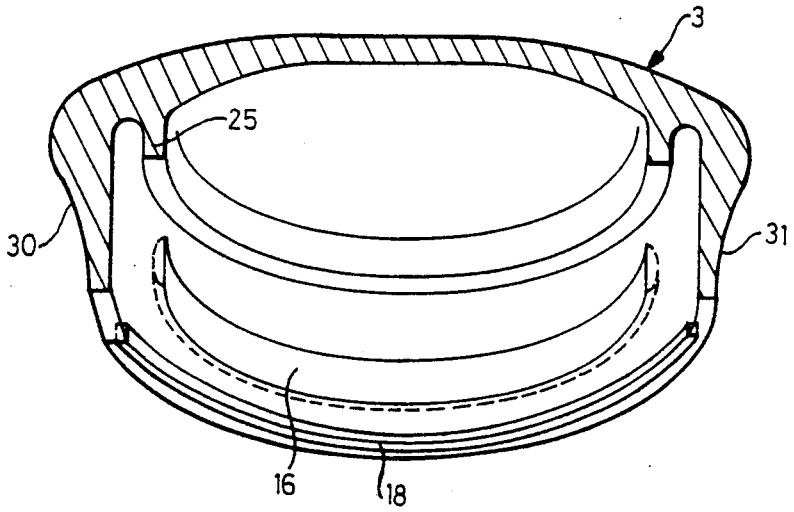
FIG. 5 is a view which is similar to FIG. 3 and shows the casing lid of the pot of FIGS. 1 to 4.
Figure 4:
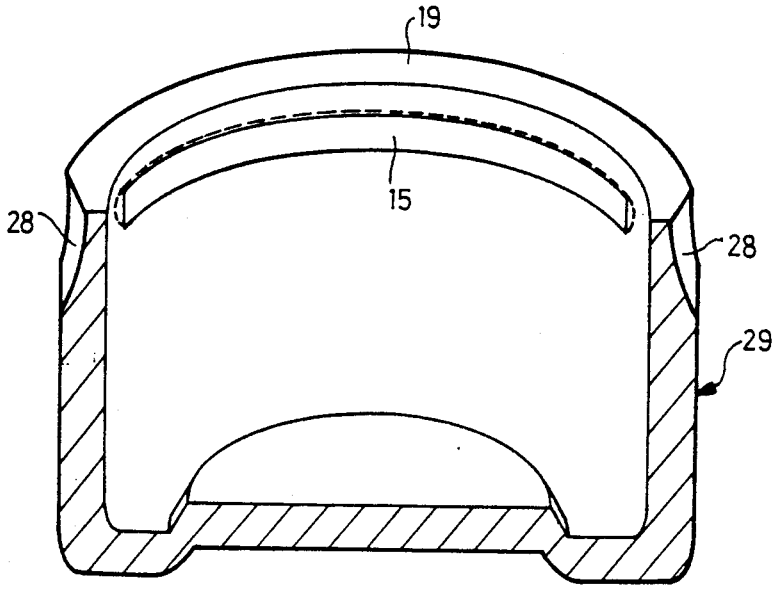
FIG. 4 is a schematic view in axial cross-section with one-half in perspective, showing the casing body of the pot of FIGS. 1 to 3.

FIG. 6 illustrates an alternative form of snap-action closure. In this alternative embodiment, a rigid hook **50*a* extends from the upper annular member 9 and snap-actingly engages within a rectangular cut-out portion 50*b* of the inner end of a horizontal push-button 60 which is joined to the lower annular member 8 by means of a vertical flexible strip 110 delimited by two parallel slits 111, 112 of the lower annular member 8. In this alternative embodiment, the push-button for opening the casing is thus integral with the casing body instead of the lid as in the example of FIGS. 1 to 5**.

In the example described and illustrated, the container 1 and the ring 7 are molded in one piece but it is conceivable to construct the container and the ring separately and then to assemble them together in accordance with a known technique such as adhesive bonding or ultrasonic welding although this requires an additional operation.

Moreover, the cover 11 can be secured to the casing lid 3 by snap-fastening, adhesive bonding, welding or any other known technique instead of being latched in the upper annular member 9 as described and illustrated. Consideration can also be given to the possibility of forming the lid 3 and the cover 11 by molding in a single piece. However, it appears generally desirable to form the cover 11 by molding from more flexible material than the ring 7, the container 1 and/or the lid 3. Flexible material such as polyethylene permits better repeated interengagements and therefore better leak-tightness than material having relatively high hardness such as polypropylene which has, on the other hand, a more attractive appearance and greater rigidity, these properties being more suitable for the presentation, decoration and consistency which are expected of a pot of good quality and appearance from a commercial standpoint.

Furthermore, the guarantee membrane 14 can equally well be sealed on the edge face of the neck of the container 1 instead of the protective cap 12. To this end, the annular shoulder 26 of the inner edge of the container 1 should preferably be sufficiently hollow to ensure that the edge face of the neck of the container is located beyond the edge face of the peripheral flange of the protective cap 12. When this latter is latched in the groove 27, if the two edge faces of the container neck and of the latched protective cap are at the same level, it is equally possible to seal the guarantee membrane 14 on both edge faces at the same time.

As can readily be understood, the shapes of the container 1 and of the casing 2, 3 are not necessarily homothetic. The connection between container and casing by means of the ring 7 permits many different adaptations such as, for example, between a cylindrical container of revolution and a polygonal or oval casing or the like.

What is claimed is:

1. A packaging pot for marketing various products, comprising a container housed within a casing body having a top portion and covered by a casing lid having a bottom portion which lid pivots about a horizontal articulation with a resilient snap-action closure system releasable by manual action on an externally projecting lug, wherein the container is clamped within a single-piece ring comprising a lower annular member which is integral with the container and a pivoting upper annular member which is joined to the lower annular member by means of a flexible hinge-strap, the two annular members being provided respectively with complementary snap-fastening elements, the top portion of the casing body being secured to the snap fastening element on the lower annular member, and the bottom portion of the casing lid being secured to the snap fastening element on the upper annular member.

2. A pot according to claim 1, wherein the elements for relative snap-fastening of the two annular members comprise a strip which can be resiliently thrust back by hand towards the interior of the pot and which is derived from one of the annular members, said strip being provided with a terminal hook directed outwards in the vicinity of an external extension constituting a snap-fastening release push-button which projects outside the pot between the casing body and the casing lid whilst an inwardly directed oppositely-acting hook is derived from the other annular member.

3. A pot according to claim 1, wherein said pot comprises two symmetrical snap-fastening devices located in diametrically opposite relation on each side of the hinge-strap.

4. A pot according to claim 1, wherein said pot comprises a standardized container-ring assembly and separate interchangeable body and lid casing elements, which are attached respectively on the upper and lower annular members of the ring.

5. A pot according to claim 1, wherein the container and the ring are formed by molding in one piece.

6. A pot according to claim 1, wherein said pot further comprises a cover which fits externally over the upper edge of the container and is secured to the upper annular member of the ring.

7. A pot according to claim 1, wherein said pot further comprises a detachable protective sealing cap which is resiliently engaged in an annular groove cut within the top portion of the neck of the container and provided on its external top face with a projecting holding lug.

8. A pot according to claim 7, wherein the protective cap has an upwardly extending flange and said holding lug projects upwardly to a point below the upper edge of said flange and made inaccessible until the pot is used for the first time by means of a tearable guarantee membrane which is sealed on the outer peripheral edge of the protective cap.

9. A pot according to claim 1, wherein said pot further comprises a guarantee membrane which can be torn off when used for the first time, said membrane being sealed on the edge face of the neck of the container and if necessary on the periphery of the protective cap.

* * * * *